United States Patent [19]

Meenen

[11] 4,300,895

[45] Nov. 17, 1981

[54] STRIPPER ROLLER ASSEMBLY

[75] Inventor: Raymond Meenen, Hawthorne, N.J.

[73] Assignee: Mayflower Electronic Devices, Inc., Little Ferry, N.J.

[21] Appl. No.: 94,668

[22] Filed: Nov. 15, 1979

[51] Int. Cl.[3] ..... B65H 45/00

[52] U.S. Cl. ..... 493/416; 198/631; 493/400; 493/405

[58] Field of Search ..... 270/61 R, 66; 198/631, 198/472, 862, 812; 74/89.17; 248/429; 493/405, 400, 416

[56] References Cited

U.S. PATENT DOCUMENTS

| | | | |
|---|---|---|---|
| 2,275,656 | 3/1942 | Saunders | 248/429 |
| 3,324,987 | 6/1967 | Kiesser | 198/631 |
| 3,339,914 | 9/1967 | Grantham | 270/66 |
| 3,620,139 | 11/1971 | Kulwicki | 198/862 |
| 4,104,847 | 8/1978 | Glandon | 198/631 |

*Primary Examiner*—Edgar S. Burr
*Assistant Examiner*—A. Heinz

[57] ABSTRACT

A stripper roller assembly employs first and second parallel spaced horizontally elongated rollers lying in a horizontal plane. A plurality of spaced horizontally elongated members are disposed at right angles to said rollers. Each member extends between and is secured to said rollers, each roller being freely rotatable about its horizontal axis in said members. A like plurality of horizontally elongated rack gear devices cooperate with the members. Each rack device is disposed adjacent a corresponding member intermediate said rollers and is horizontally slidable along the corresponding member between a first position at which the horizontal separation between the rack means are a selected one roller is a minimum and a second position at which said separation is a maximum. A horizontally elongated shaft is rotatably supported by the stationary main frame of the folding machine with which the assembly is used. A like plurality of pinion gears are keyed to the shaft, each pinion gear engaging a corresponding one of said rack devices.

A like plurality of horizontal cylinders cooperative with the devices, each cylinder having a horizontal piston slidable back and forth therein between a fully withdrawn position and a fully extended position, one end of each piston being always disposed outside of its corresponding cylinder and being coupled to a corresponding one of said rack devices to cause same to slide back and forth between its first and second positions.

4 Claims, 1 Drawing Figure

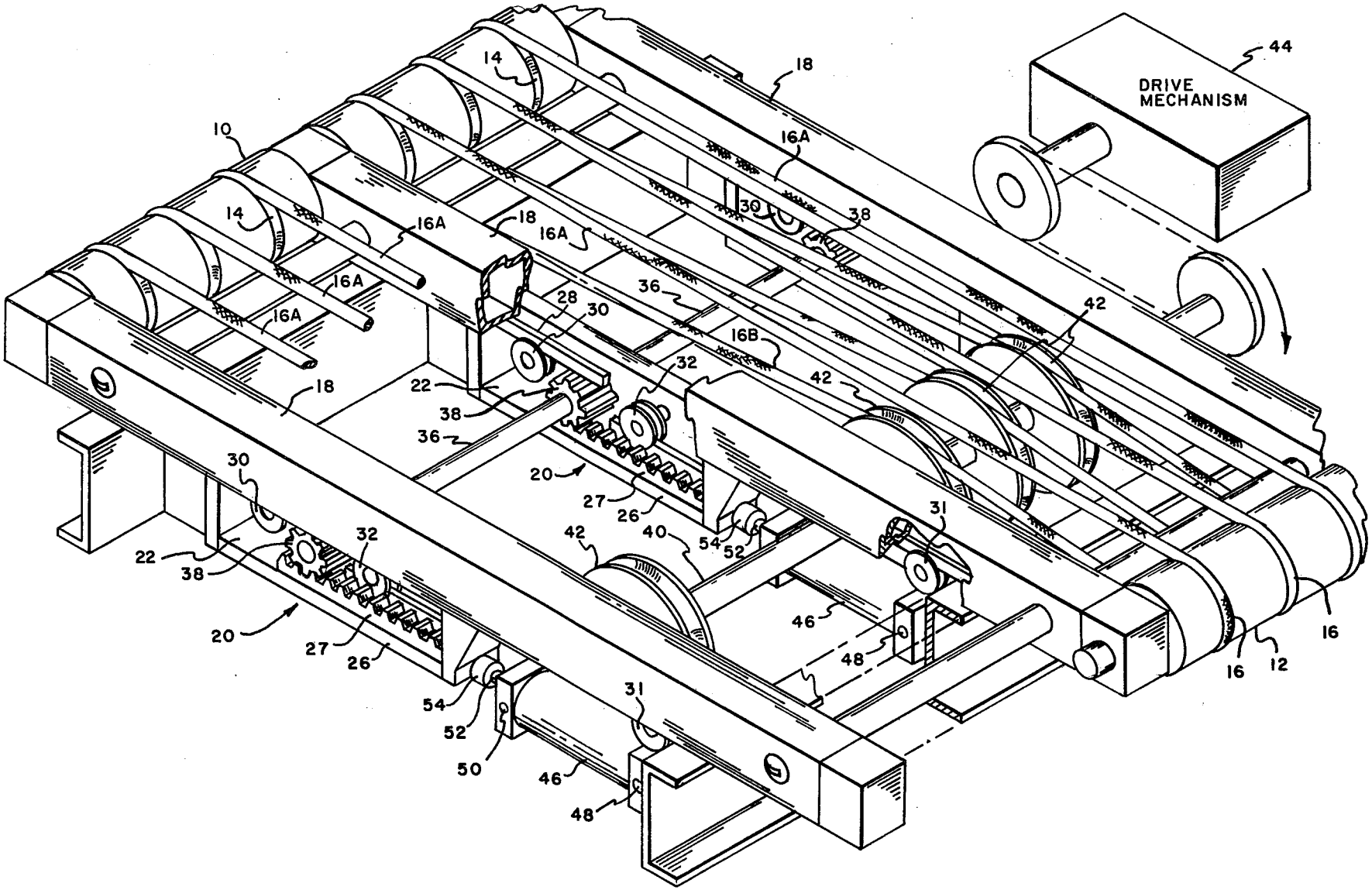
DRIVE MECHANISM
44
16
12
16
42
31
48
46
38
18
16A
30
16B
52
54
32
36
40
26
27
28
20
42
31
48
46
14
18
16A
38
22
36
50
52
54
16A
32
26
27
16A
18
16A
30
38
20
10
14
22

STRIPPER ROLLER ASSEMBLY

CROSS REFERENCE TO RELATED CO-PENDING PATENT APPLICATION

The present application is directed toward a stripper roller assembly adapted for use with curtain folding machines disclosed in co-pending patent application Ser. No. 032,527, filed Apr. 23, 1979, now U.S. Pat. No. 4,264,066, and assigned to the assignee of the present application.

BACKGROUND OF THE INVENTION

As described in more detail in said co-pending application, a shower curtain is fed vertically downward past a set of four parallel horizontally elongated vertically spaced rollers. The two uppermost rollers, the first and second rollers are vertically aligned with each other. The two lowermost rollers, the third and fourth rollers, are also vertically aligned with each other but are horizontally offset from the two uppermost rollers.

As the curtain passes downward, a properly timed first air jet is produced and discharged horizontally to force the curtain between the first and second rollers to produce a first fold in the curtain. Thereafter, a second air jet is produced and discharged inclinedly downwards to force the first folded curtain between the second and third rollers to form a second fold in the curtain. After a further interval, a third air jet is produced and discharged horizontally to force the twice folded curtain between the third and fourth rollers to form a third fold in the curtain.

The curtain, during the step of forming the first fold, must be supported in order to be maintained in proper position for the second fold. A stripper belt roller assembly provides this support. When the first air jet is produced, the assembly is caused to move away from the second and third rollers to support the curtain. After the second fold is produced, the assembly movement is reversed and the assembly is caused to move toward the second and third rollers.

The stripper roller assembly takes the form of an endless belt having top and bottom portions wrapped around two horizontal parallel rollers. One of the rollers carries a small toothed gear which engages a larger driving gear. Rotation of the driving gear rotates the roller gear driving the belt. A solenoid operated air cylinder is secured through a linkage arrangement to pivotable supports which support the rollers. The endless belt is slightly inclined from the horizontal.

This stripper roller assembly functions very well for curtain widths of seventy-two inches or less. However, when larger widths are used, this assembly exhibits certain significant defects which impair its usefulness. The total distance of movement toward and away from the fold rollers is too small to accommodate the larger curtain width. The velocity of the assembly movement is too slow, and the curtain does not fold properly. Moreover, the belt angle of inclination becomes significant since the larger width curtain folds tend to slide out of position if not held in horizontal position by the assembly during operation.

This application is directed toward a new type of stripper roller assembly which overcomes these difficulties.

SUMMARY OF THE INVENTION

In accordance with the principles of this invention, the stripper roller assembly employs first and second parallel horizontally elongated rollers lying in a horizontal plane and parallel to the fold rollers in the folding machine. A plurality of spaced horizontally elongated members extend between and are secured to said rollers, each member being disposed at right angles to the rollers. Each roller is freely rotatable about its horizontal axis in the members.

The assembly further employes a plurality of horizontally elongated rack gear means which cooperate with the members. Each rack means is disposed adjacent a corresponding member intermediate said rollers and is horizontally slidable along the corresponding member. Each means has a first position at which the horizontal separation between the means and a corresponding roller is a minimum and a second position at which the separation is a maximum.

A horizontally elongated shaft is parallel to and is disposed between said rollers. The shaft is supported rotatably on the stationary main frame of the folding machine. The shaft carries a like plurality of pinion gears keyed thereto, each pinion gear engaging a corresponding one of said rack means.

The assembly further includes a like plurality of horizontal cylinders, each cylinder having a horizontal piston slidable back and forth therein between a fully withdrawn position and a fully extended position, one end of each piston being always disposed outside of its corresponding cylinder and being coupled to a corresponding one of said rack means to cause same to slide back and forth between its first and second positions. Each cylinder is secured to the main frame.

A plurality of elongated spaced apart endless belts lying in parallel vertical planes extending at right angles to said rollers extend around and between said rollers with upper portions disposed above said rollers and lower portions disposed below said rollers, said belts being in friction tight engagement with said rollers.

A horizontally elongated drive shaft is parallel to said rollers and to said gear supporting shaft. The drive shaft is disposed below and between said rollers. A like plurality of spaced vertical pulleys are secured to said drive shaft and are rotatable therewith, each pulley being aligned with a corresponding one of said belts and being disposed in friction tight belt driving relationship therewith while engaging the lower portion thereof. A drive mechanism is coupled to said drive shaft to rotate same about its horizontal axis whereby said belts are rotated accordingly.

The assembly is operated in the folding machine with the timing previously described. In order to move the assembly away from the rollers, the pistons are caused to move simultaneously from withdrawn to extended positions. The piston motion is transmitted via the rack means to said members and rollers which move outward as a unit with respect to said cylinders until the separation between rack means and the selected roller is a minimum and the folded curtain is supported. When said pistons are caused to move simultaneously from extended to withdrawn positions, the assembly movement is reversed, the unit moving inward with respect to said cylinders until said separation is a maximum. Each rack means during movement causes rotation of the corresponding pinion gear and the shaft to which it is attached.

This assembly is always maintained in horizontal position with the assembly rollers being parallel to the feed rollers in the machine. The pinion gears and associated shaft maintain his parallel relationship negating differential travel speeds of the pistons which could otherwise impair this relationship. It can be scaled up or down in dimensions as required to support differing curtain widths and lengths within a wide range without changing the design. The rack gear means, pinion gears and cylinders provide the speed of movement necessary. Moreover, the upper portions of the belts are held in a horizontal plane at all times.

In addition, as will be explained in more detail hereinafter, the direction of rotation of the drive shaft can be selected in such manner that the speed of movement of the upper portions of the belts will be slightly accelerated when the unit is moving away from the fold rollers and will be slightly decelerated when the unit is moving toward the fold rollers. This eliminates small wrinkles which tend to form in the folded curtain when the direction of rotation of the drive shaft is reversed.

BRIEF DESCRIPTION OF THE DRAWINGS

The accompanying FIGURE is a partially cut away perspective view of the invention.

DETAILED DESCRIPTION OF PREFERRED EMBODIMENTS

As previously explained, the roller assembly is designed to operate in a folding machine of the type described in the above identified co-pending application. This machine is not shown in the drawings of the present application.

Referring now to the drawings, first and second parallel spaced horizontally elongated rollers 10 and 12 lie in a horizontal plane. These rollers have aligned spaced circular grooves 14 in their outer surfaces. Each aligned groove pair of both rollers is engaged by a corresponding elongated endless belt 16 which extends around and between the rollers. The belts have upper portions 16A disposed above the rollers and lowers portions 16B below the rollers. The belts are in friction tight engagement with the rollers. The upper portions 16A lie in a horizontal plane.

Three like horizontally elongated members 18 are disposed at right angles to the rollers and extend between and are secured to the rollers. One member supports one set of corresponding ends of the rollers; the second member supports the opposite set of corresponding ends of the members; and the third member supports the midpoints of both rollers. Bearings in the members enable each roller to be freely rotatable about its horizontal axis in all of the members.

Three like horizontally elongated gear means identified generally at 20 cooperate with members 18. Each means 20 has an opening 22. The bottom horizontal edge of the opening carries a rack gear 27 and a horizontally elongated rail 26 disposed next to gear 27. The upper horizontal edge of the opening carries another horizontally elongated rail 28 parallel to and disposed above rail 26.

Each means 20 is disposed adjacent a corresponding member 18 intermediate the rollers. Each member has two spaced vertical wheels 30 and 32 secured axially thereto and freely rotatable in a vertical plane about their horizontal axis. Each wheel 30 and 32 has a peripheral groove. Wheel 30 is disposed so that its groove engages rail 28 while wheel 32 is disposed with its groove engaging rail 26. The wheels and rails provide interconnecting engagement devices which keep each means-member pair in horizontal slidable engagement.

A horizontally elongated shaft 36 parallel to and disposed between the rollers extends between and is supported by three bearings mounted on the main frame of the folding machine. The shaft 36 carries three spaced pinion gears 38, each gear being keyed to shaft 36 and engaging a corresponding rack gear 27.

A horizontally elongated drive shaft 40 parallel to the rollers and shaft 36 is disposed below and between the rollers. Shaft 40 carries a plurality of spaced vertical pulleys 42 which are rotated by and are secured to the shaft. The shaft is disposed below the belts so that each pulley is aligned with a corresponding belt and is disposed in friction tight belt driving relationship by engaging the lower portion of the belt.

A belt drive or other mechanism shown generally at 44 and powered by the folding machine rotates shaft 40 to rotate the belts. For a given speed of shaft rotation, and fixed pulley and belt dimensions, the speed of belt rotation will not change if the shaft is moved closer to one roller and away from the other as compared to the position shown in the drawings.

Three double acting horizontally elongated air cylinders 46 are used. These cylinders receive air from the folding machine. When air is supplied to port 48, the horizontal piston 52 in the cylinder is fully extended; when air is supplied to port 50, the horizontal piston 52 is fully withdrawn. Each cylinder is associated and aligned with a corresponding rack means 20 with the free exposed end 54 of the cylinder being connected to the means 20. The opposite ends of the cylinders are also secured to the main frame of the folding machine.

The shaft 26, rollers 10 and 12, members 18 and belts 20 form a unit. When air is supplied to ports 48 of all cylinders simultaneously, the pistons extend and the piston movement is transmitted via the rack means 20 to the members 20 and rollers 10 and 12 which move outward as a unit. The rack means move away from the cylinder, moving the rack means. These means engage and cause the corresponding pinion gears to rotate. Since the pinion gears are keyed to the shaft 36, the entire moving assembly is held parallel to the fold rollers of the machine, negating any travel speed differentials among the air cylinders which would otherwise tend to cause nonparallel movement of the assembly relative to the feed rollers. When the pistons are fully extended, the separation between each means 20 and roller 10 is a minimum while the separation between each means 20 and the roller 12 is a maximum. This movement is the movement away from the fold rollers in the folding machine.

When air is supplied to the ports 50 of all cylinders simultaneously, the pistons are withdrawn. The piston movement is transmitted via the rack means 20 to the members 20 and rollers 10 and 12 which move inward as a unit. The rack means move toward the cylinders, again causing the pinion gears to rotate. After the pistons are fully withdrawn, the horizontal separation between each means 20 and roller 12 is a minimum whereby the separation between each means 20 and roller 10 is a maximum. This movement returns the unit back to the original or start position with respect to the fold rollers.

As the rack means approach the extreme outward position or extreme inward position, the speed of rotation of the pinion gears decreases because of the cushioning effect of the end cushions in the air cylinders.

The drive shaft direction of rotation is shown as clockwise in the drawing. This arrangement results in a slight acceleration of the speed of horizontal movement of the belts (as compared to the speed of movement when the unit is not moving) when the unit is moving away from the cylinder and a slight deceleration when the unit is moving toward the cylinders.

What is claimed is:

1. A stripper roller assembly for use with a folding machine having a stationary main frame, said assembly comprising:

first and second parallel spaced horizontally elongated rollers lying in a horizontal plane;

a plurality of spaced horizontally elongaged members disposed at right angles to said rollers, each member extending between and being secured to said rollers, each roller being freely rotatable about its horizontal axis in said members, each member having spaced vertical wheels on one side thereof which rotate freely about horizontal axes;

a like plurality of horizontally elongated (means) rack devices which cooperate with said members, each (means) device being disposed adjacent a corresponding member, each (means) device having a rectangular opening having top and bottom edges, each (means) device having a horizontal rack gear on the bottom edge of its opening and rails on the top and bottom edges of the opening, the wheels of each member slidably engaging the rails on the adjacent (means) device whereby each (means) device is maintained in horizontal sliding engagement with the corresponding adjacent member, each (means) device being horizontally slidable toward and away from the first roller along the corresponding member between a first position at which the horizontal separation between each (means) device and the first roller is a minimum and a second position at which this separation is a maximum;

a horizontally elongated shaft parallel to and disposed between said rollers, said shaft being supported on said frame and rotatable about its axis, said shaft extending through the rectangular openings and carrying a like plurality of pinion gears secured thereto, each pinion gear engaging a corresponding one of said rack gears; and a like plurality of horizontal cylinders, each cylinder having a cylinder element and a horizontal piston slidable back and forth therein between a fully withdrawn position in said element and a fully extended position, one end of each piston being always disposed outside of its corresponding cylinder element and being coupled to a corresponding one of said (means) devices to cause same to slide back and forth between its first and second positions, each cylinder element being secured to said main frame whereby when the pistons are caused to move simultaneously from withdrawn to extended positions, the (means) devices slide along the corresponding members toward the first roller while the rack gear of each (means) device simultaneously engages and rotates the corresponding pinion gear, causing the members and rollers to move outward as a unit with respect to the cylinder elements until the (means) devices attain said first position and whereby when the pistons are caused to move simultaneously from extended to withdrawn positions, the members and rollers move inward as a unit with respect to the cylinder elements until the (means) devices attain said second position.

2. The assembly of claim 1 further including a plurality of elongated spaced apart endless belts lying in parallel vertical planes extending at right angles to said rollers, said belts extending around and between said rollers with upper portions disposed above said rollers and lower portions disposed below said rollers, said belts being in friction tight engagement with said rollers.

3. The assembly of claim 2 further including a horizontally elongated drive shaft parallel to said rollers and to said gear supporting shaft, said drive being disposed below and between said rollers, and a like plurality of spaced vertical pulleys secured to said drive shaft and rotatable therewith, each pulley being aligned with a corresponding one of said belts and being disposed in friction tight belt driving relationship therewith by engaging the lower portion of the corresponding belt.

4. The assembly of claim 3 further including drive means coupled to said drive shaft to rotate same about its horizontal axis whereby said belts are rotated accordingly.

* * * * *